US006205904B1

(12) United States Patent
Boutet et al.

(10) Patent No.: US 6,205,904 B1
(45) Date of Patent: Mar. 27, 2001

(54) MECHANISM FOR FEEDING MUNITION ELEMENTS TO AN ARTILLERY CANNON

(75) Inventors: Claude Boutet, Bourges; Thierry Fougeroux, Saint Eloy de Gy, both of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/302,295

(22) Filed: Apr. 30, 1999

(30) Foreign Application Priority Data

Apr. 30, 1998 (FR) ..... 98 05646

(51) Int. Cl.[7] ..... F41A 9/42
(52) U.S. Cl. ..... 89/45; 89/46; 89/33.1
(58) Field of Search ..... 89/45, 46, 47, 89/34, 33.1

(56) References Cited

U.S. PATENT DOCUMENTS 4,494,441 1/1985 Magnuson ..... 89/38
4,882,972 * 11/1989 Raymond ..... 89/34
5,335,580 * 8/1994 Mouterde et al. ..... 89/46
5,353,679 * 10/1994 Nordmann ..... 89/34
5,440,964 * 8/1995 Bender-Zanoni ..... 89/34
5,458,044 * 10/1995 Delbos ..... 89/45
5,844,163 * 12/1998 Lindskog ..... 89/46

FOREIGN PATENT DOCUMENTS 2743414 7/1997 (FR) .

* cited by examiner

*Primary Examiner*—J. Woodrow Eldred
(74) *Attorney, Agent, or Firm*—Parkhurst & Wendel, L.L.P.

(57) ABSTRACT

The subject of the invention is an ammunition element (3,4) feed device (1) for an artillery cannon, notably in projectiles (3) or propellant charge modules (4), and comprising at least one storage magazine (2) for the ammunition elements that incorporates at least one row **(2*a*, 2*b*, 2*c*, 2*d*), a device (28) to transfer the ammunition elements from the magazine to a loading chute (5) and motor means enabling the ammunition elements to be moved up one row to bring them onto the transfer device (28), feed device is characterized in that each row (2*a*, 2*b*, 2*c*, 2*d*)** of the magazine comprises:

a support plate (12) on which the ammunition elements (3,4) are arranged with their axes perpendicular to their direction of movement in the row, at least one conveyor belt (15) activated by motorization (16), said belt pressed to the ammunition elements of the row and constituting the motor means.

18 Claims, 10 Drawing Sheets

MECHANISM FOR FEEDING MUNITION ELEMENTS TO AN ARTILLERY CANNON

FIELD OF THE INVENTION

The technical scope of the invention is that of an ammunition element feed device for an artillery cannon.

BACKGROUND OF THE INVENTION

So as to increase the firing rate of artillery cannons we are brought to design weapon systems in which the feed systems for projectiles and/or propellant charges are automatic.

Modern pieces of artillery thus comprise more often than not a storage magazine for projectiles or propellant charges and transfer means enabling said projectiles and/or propellant charges to be transferred to the weapon chamber.

Patents FR2743411, FR2743412, FR2743413 and FR2743414 thus disclose various magazine systems for propellant charges as well as various transfer devices.

Patent EP616185 discloses in particular a feed device comprising a storage magazine for ammunition elements (in this case modular propellant charges) that incorporates at least one row. This device also incorporates a device to transfer said propellant charge modules from the magazine to a loading chute as well as motor means enabling the modules to be moved to the next row to bring them onto the transfer device.

Several rows of propellant charge modules are thus pushed simultaneously by means of a rake pressing on a rear face of the last charge module. The front modules thus find themselves pushed into a cell of a transfer device.

The charge modules are then distributed by means of gravity by the transfer device, the transfer being carried out by controlling the pivoting of one or more retention lugs.

Such a device has numerous drawbacks.

First of all, it can not be used for the storage and distribution of projectiles.

Secondly, it generates numerous mechanical strains on the modules of the propellant charge, notably shocks due to the distribution by gravity and the strains exerted by the lugs during the transfer phases (vibrations).

Lastly, the system is bulky, costly in terms of energy and complex to restock with modules.

SUMMARY OF THE INVENTION

The aim of the invention is to propose a feed device that overcomes such drawbacks.

Thus, the device according to the invention is of a simple and compact design. It enables the propellant charge modules to be stored and fed in a manner that is both reliable and that avoids mechanical strains.

Its design enables it to be easily adapted to the storage and feed of projectiles to a weapon system.

It thereby becomes possible for an extremely compact system to be made that ensures the fully automatic feed of the weapon, both in projectiles and in propellant charges.

Lastly, the device according to the invention is fully reversible and it thereby easily ensures the replenishing of the magazine with both projectiles and propellant charges.

Thus, the subject of the invention is that of an ammunition element feed device for an artillery cannon, notably in projectiles or propellant charge modules, and comprising at least one storage magazine for the ammunition elements that incorporates at least one row, a device to transfer the ammunition elements from the magazine to a loading chute and motor means enabling the ammunition elements to be moved up one row to bring them onto the transfer device, such feed device being characterised in that each row of the magazine comprises:

- a support plate on which the ammunition elements are arranged with their axes perpendicular to their direction of movement in the row,
- at least one conveyor belt activated by motorization, said belt pressed to the ammunition elements of the row and constituting the motor means.

The support plate will advantageously incorporate reception cells for the ammunition elements.

According to another characteristic of the invention, the device incorporates at least two retention rollers for each ammunition element, rollers pressing the conveyor belt on the ammunition element and able to distance itself from said element against the action of elastic return means to allow its displacement.

Each retention roller is preferably carried by a lever able to pivot with respect to a frame, lever to which a traction spring has been fastened whose other end is fastened to one end of another lever carrying the next roller.

The device can comprise two side cheeks providing guidance for the charge elements.

According to a particular embodiment more particularly intended to move projectiles, the device comprises two conveyor belts parallel to each other, each belt being pressed onto a different part of the projectile body.

In this case, the device can comprise a cowling incorporating a part having a profile ensuring the centring of a projectile nose cone.

According to another characteristic of the invention, the device comprises at least one tipping part mounted pivoting with respect to the support plate, such part being globally L-shaped whose first branch is arranged in the closed position in the extension of the support plate and incorporates a housing to accommodate an ammunition element, and a second branch perpendicular to the first ensures that the element is retained in the magazine, the tipping part being placed between the row in question of the magazine and the transfer device, the pivoting of the tipping device from its closed position to an open position allows the passage of the ammunition element from the magazine to the transfer device.

The device can incorporate a controllable lock ensuring the immobilisation of the tipping part in its starting position.

According to another characteristic of the invention, the transfer device comprises at least one pivoting bucket, motor means being provided to drive the pivoting of the bucket and control means and/or unlocking means ensuring, when the bucket lies opposite a tipping part, the unlocking and/or pivoting of the tipping part in the direction of the bucket, the motor means of the bucket and the control and/or unlocking means being activated in a predefined order by means of a sequencer.

Advantageously, the tipping part comprises at least two wings forming a fork, the space separating the two wings allowing the passage of one branch of the bucket.

The control and/or unlocking means can comprise at least one rack integral with a support of the bucket, rack whose translation is driven by a motor and that is intended to co-operate with a toothed sector integral with the tipping part, the translation of the rack causing the tipping part to pivot.

During its translation, the rack will thereafter release the lock immobilising the tipping part.

According to another characteristic, the bucket is integral with a lift translating with respect to the storage magazine in a perpendicular direction to the rows of the magazine, such lift incorporating means ensuring the positioning of the bucket with respect to a row of the magazine.

These positioning means can comprise at least one sliding pin integral with the lift and co-operating with a hole made in the magazine frame.

According to a preferred embodiment, the lift incorporates two compartments, a first compartment receiving a first projectile transfer bucket and a second compartment comprising at least two buckets to receive propellant charge modules.

The storage magazine in this case comprises at least two groups of two superimposed rows, a first row of projectiles and a second row, arranged above or below the first one, and comprising at least two sub-rows of propellant charge modules, such that when the first compartment of the lift is positioned opposite the first row of projectiles, the second compartment of the lift is positioned opposite the sub-rows of propellant charge modules, a projectile therefore being able to be transferred at the same time as the charge modules.

BRIEF DESCRIPTION OF THE DRAWINGS

The invention will be better understood after reading the description that follows of a particular embodiment, such description being made in reference to the appended drawings, in which.

DETAILED DESCRIPTION OF THE INVENTION

Figure 1:
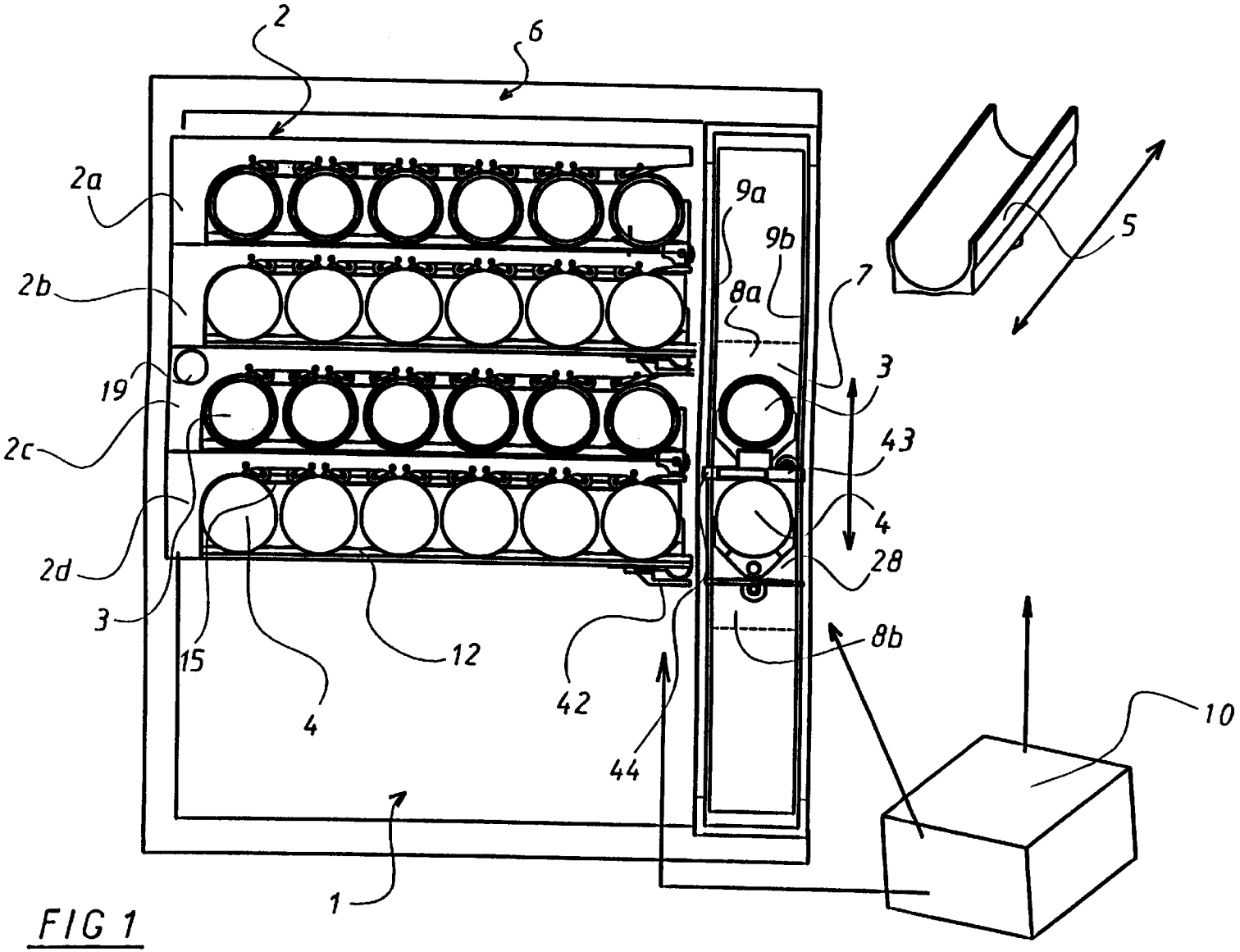
FIG. 1 is a global schematic view of a feed device according to the invention.

With reference to FIG. 1, an ammunition element (projectiles 3 and modular propellant charges 4) feed device 1 for an artillery cannon comprises a magazine 2 in which to store the ammunition elements and a device 28 to transfer the ammunition elements from magazine 2 towards a loading chute 5.

The loading chute is integral with a transfer arm that allows it to be positioned in the chamber of a weapon (not shown) to enable loading. It will be coupled with a positioning system of a known type (not shown). This "downstream" part of the feed device is well known to the expert (notably by patents FR2721387 and FR2743411), it does not form part of the present invention and will therefore not be described here in any further detail.

Magazine 2 represented here incorporates four parallel rows 2*a*, 2*b*, 2*c* and 2*d*. Two rows (2*a*, 2*c*) receive projectiles and the other two rows (2*b*, 2*d*) receive propellant charge modules.

Such a configuration is limited to four rows to facilitate the clarity of the description and the figures. It is naturally possible for a magazine to be designed that incorporates more rows of ammunition elements. It is also possible for a device to be designed, without departing from the scope of the invention, whose magazine contains only projectiles or only propellant charges.

Each row of the magazine is formed by an autonomous motorised sub-assembly that is fastened to a mechanical welded structure 6.

Transfer device 28 incorporates a lift 7 incorporating two compartments 8*a* and 8*b* inside which pivoting buckets are arranged as will be explained later. The lift moves on guide rails 9*a*, 9*b* such as to position each compartment 8*a* and 8*b* opposite a row of the magazine. Lower compartment 8*b* is intended to receive propellant charge modules and supper compartment 8*a* receives a projectile. As will be explained later, the structure of the buckets of each compartment is different and is adapted to the geometry of the ammunition element in question.

The transfer device also incorporates a certain number of motorizations (movement of the lift, tipping of the buckets . . . ). All the device motors, be they in the magazine or in the lift, are driven by an electronic sequencer 10 having received appropriate programming.

Figure 2:
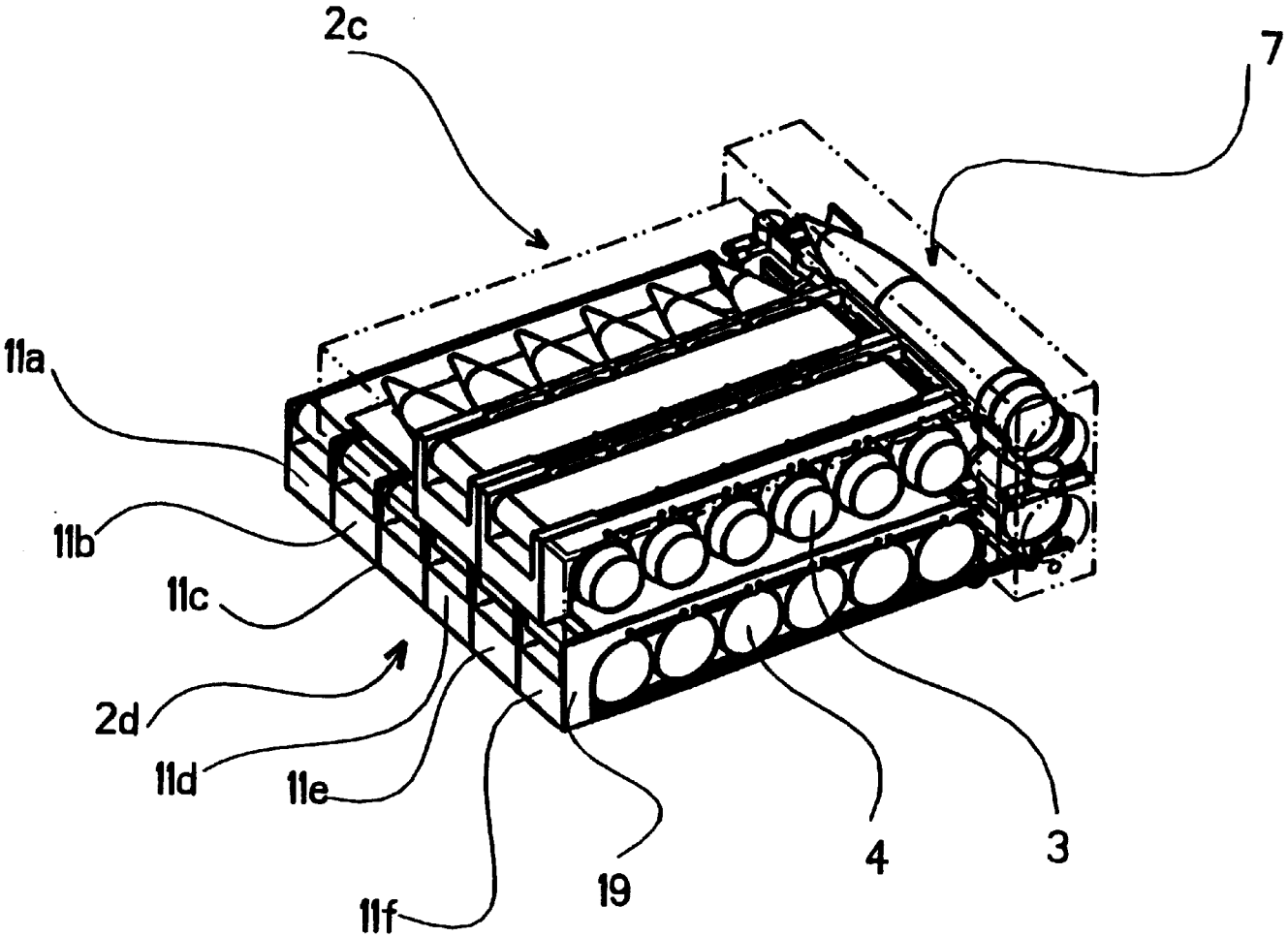
FIG. 2 is a partial perspective view showing two rows of the feed device as well as the lift.

As can be seen most clearly in FIG. 2, a row 2*d* or 2*b* of propellant charge modules is formed by the juxtaposing of several identical sub-rows 11*a* to 11*f* (in this example there are six sub-rows), each sub-row enclosing six propellant charge modules. The motorizations of each sub-row can be controlled individually. When lift 7 is positioned opposite a row, it is thus possible, according to operational requirements, to fit it with a variable number of modules (a number between one and six).

Figure 3:
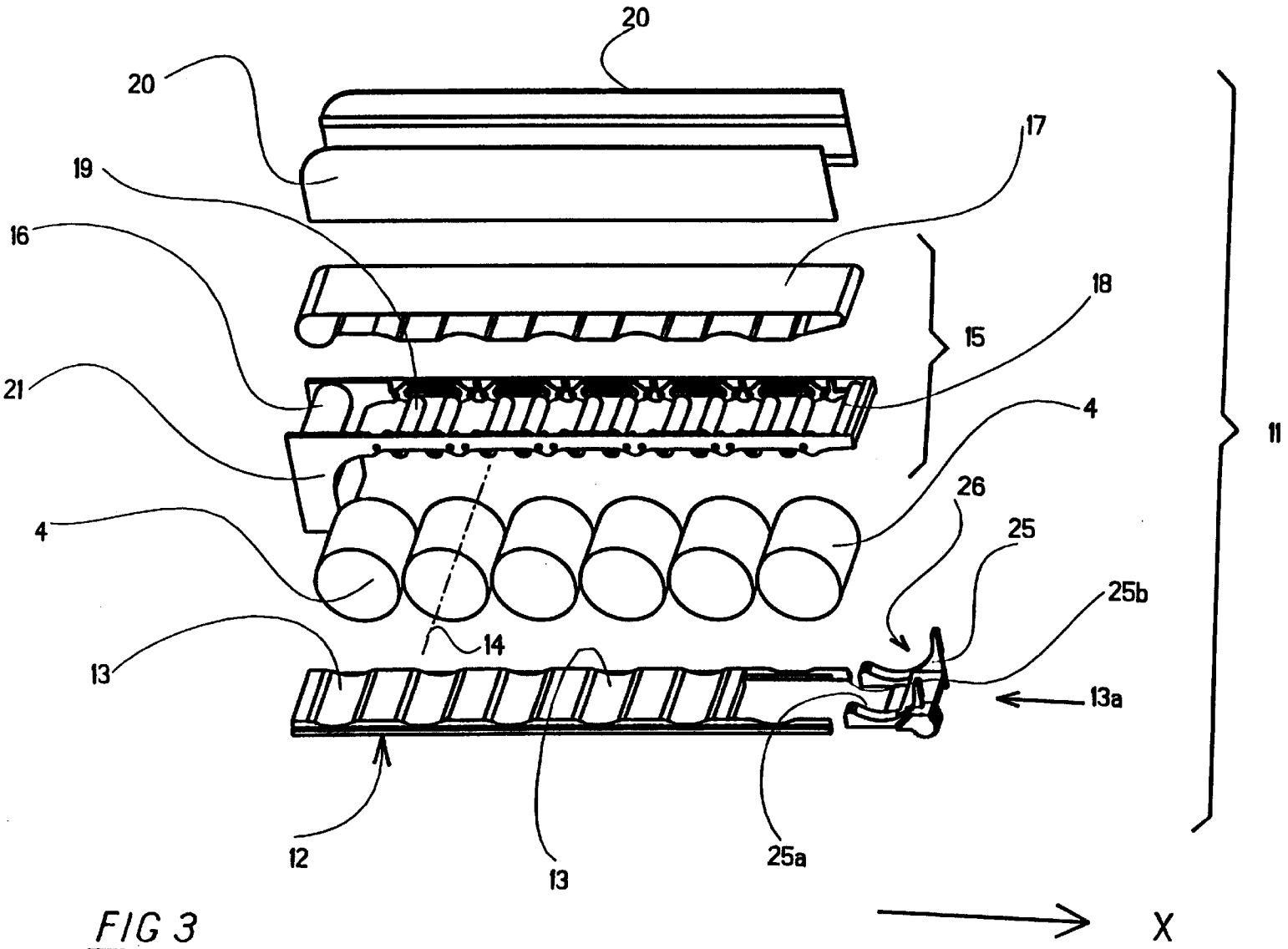
FIG. 3 is an exploded view of a row of the magazine receiving the propellant charge modules.

FIG. 3 shows an exploded view of a sub-row 11 of the magazine receiving propellant charge modules 4.

This row comprises a support plate 12 on which propellant charge modules 4 have been arranged.

The plate incorporates reception cells 13 that have a cylindrical profile with a diameter substantially equal to that of a charge module 4. These cells enable each charge module to be given a well defined position in the row. Shocks between charge modules are thereby avoided. They also provide means to hold the modules in place with a contact surface that is enough to reduce the mechanical strains due to vibrations occurring during the storage phases.

Propellant charge modules 4 are thus arranged on plate 12 with their axes 14 perpendicular to their direction of movement X in the sub-row.

Modules 4 are capped by a conveyor belt 15 activated by a motorization 16 constituted by a drive roller.

Conveyor belt 15 comprises an endless band 17 made of a supple material with good adherence properties (for example, rubber). Band 17 is shown here separated from its drive means. It is placed between drive roller 16 and an end roller 18. Retention rollers 19 enable the band to be pressed to the different charge modules. Two retention rollers 19 will be provided for each modular charge 4. The different rollers as well as band 17 are of a width equal to the length of the charge modules 4.

The different rollers are supported by a frame 21 made integral with plate 12 by conventional fastening means such as bolts (not shown). The rigidity of the sub-row is increased by a cowling that comprises two side cheeks 20 also providing lateral guidance for charge elements 4.

Figure 5:
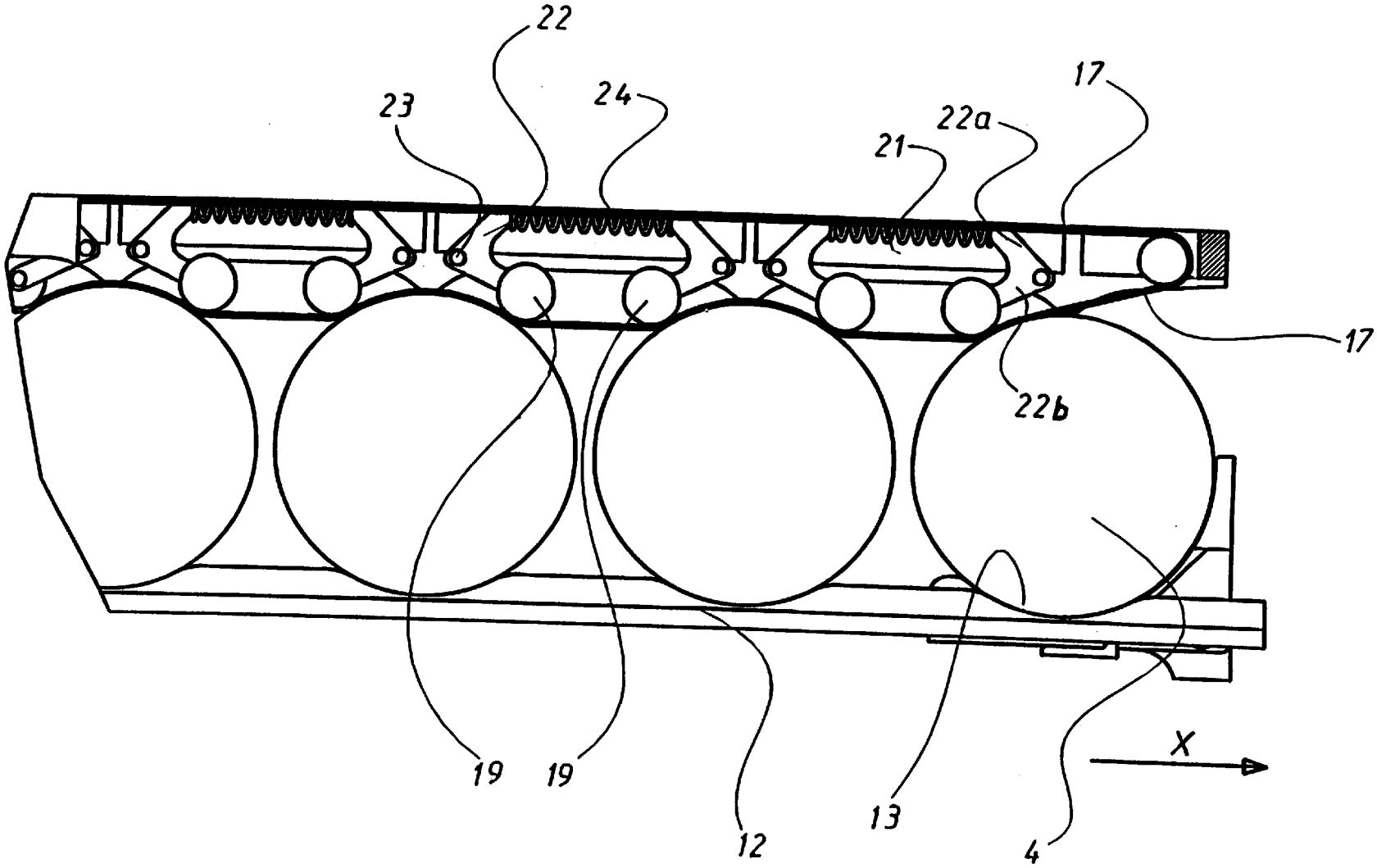
FIG. 5 is a partial view showing the retention rollers for the ammunition elements.

FIG. 5 shows a more detailed view of retention rollers 19 mounted on frame 21.

Each roller 19 is carried by a lever 22 pivoting with respect to frame 21 around a shaft 23. Lever 22 incorporates two branches 22*a*, 22*b*. A traction spring 24 is fastened to a first branch 22*a*, and the other branch 22*b* carries roller 19. The other end of spring 24 is fastened to an end 22*a* of another lever 22 carrying the next roller.

The effect of traction spring 24 is to apply the two rollers onto modular charges 4 by means of band 17 of the conveyor belt.

The conveyor belt is thus pressed firmly onto each of modular charges 4 and it has a relatively large contact surface for each one. This cylindrical contact surface has an area substantially equal to that of cell 13.

The activation of drive roller 16 will thus cause all the modular charges to roll with respect to plate 12. Each charge will come out of its cell 13 to enter the next cell. They are able to come out because of traction springs 24 that connect the retention rollers 19 two-by-two and enable them to move. Band 17 of the conveyor belt will remain pressed onto the charge modules during this displacement through the intermediary of the retention rollers thereby avoiding any relative slipping of the charge with respect to the conveyor belt.

According to the rotational direction of drive roller 16 the charges will be displaced in either one direction or the other. The motor will be made to rotate for a length of time sufficient to move the charges by one cell.

Plate 12 carries a tipping part 25 at its exit end 13*a* that is mounted pivoting with respect to the support plate. This part is globally L-shaped. When part 25 occupies its closed position as shown here, a first branch 25*a* of the tipping part lies in the extension of support plate 12 and comprises a housing 26 to accommodate a propellant charge module, such housing being of a geometry similar to that of the cells.

A second branch 25*b* is perpendicular to the first and ensures the charge module is held in place in magazine 2. It also firmly presses the charge module against conveyor belt 15 thereby allowing it to be driven by said belt and to move towards the inside of the magazine.

Figure 6:
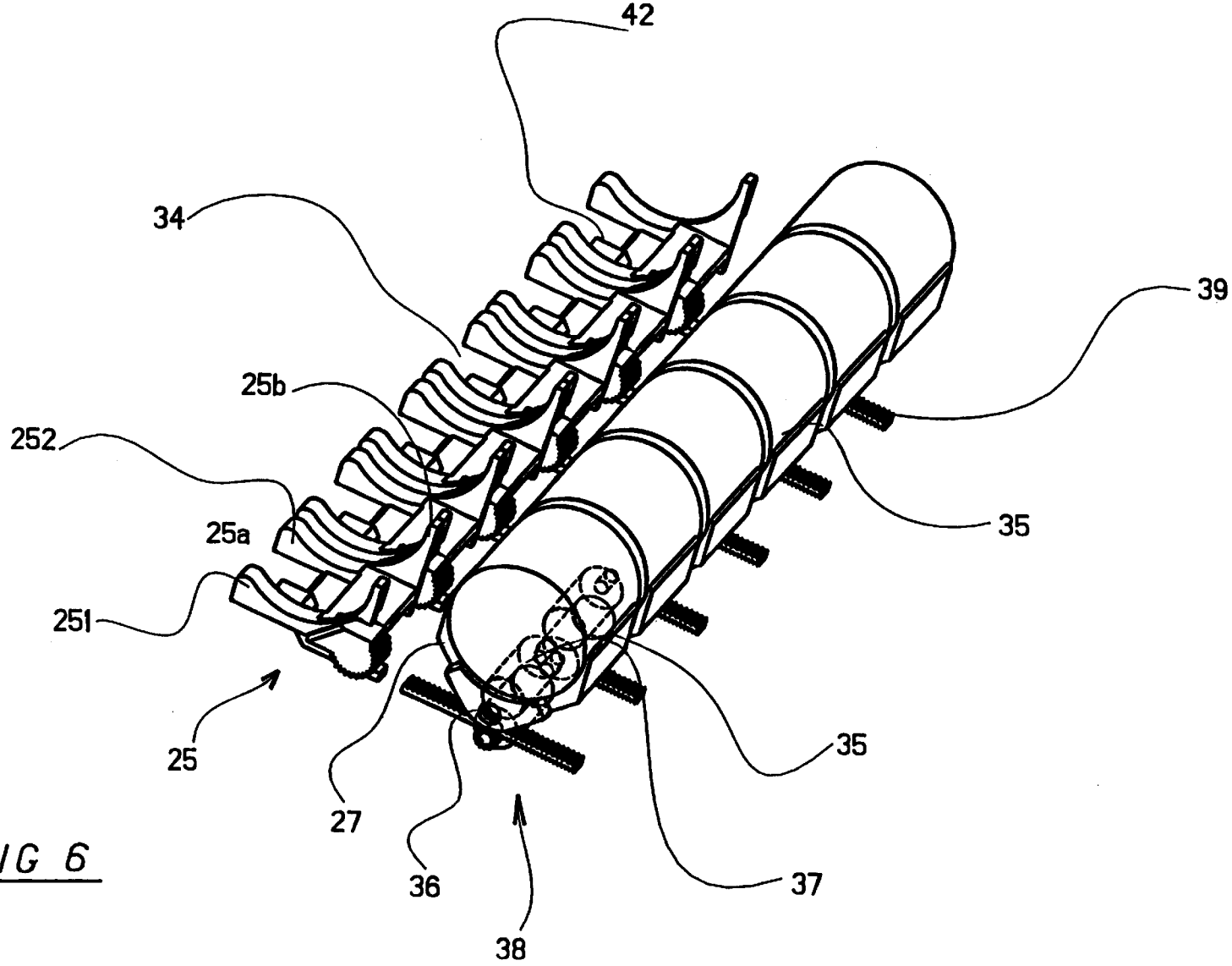
FIG. 6 is a partial perspective view showing the co-operation of the tipping parts intended to receive the propellant charge modules and the pivoting buckets associated with them.

Tipping part 25 can also be seen in greater detail in FIG. 6 and in FIGS. 8 and 9. The tipping part receiving the propellant charges incorporates at least two wings 251 and 252 forming a fork, space 34 separating the two wings is intended to allow the passage of a branch 27 of a bucket carried by the lift, as will be described later.

As tipping part 25 is placed between row 11 in question of the magazine and transfer device 28, the pivoting of the tipping part from its closed position to its open position allows the passage of the ammunition element from magazine 2 towards transfer device 28.

Figure 4:
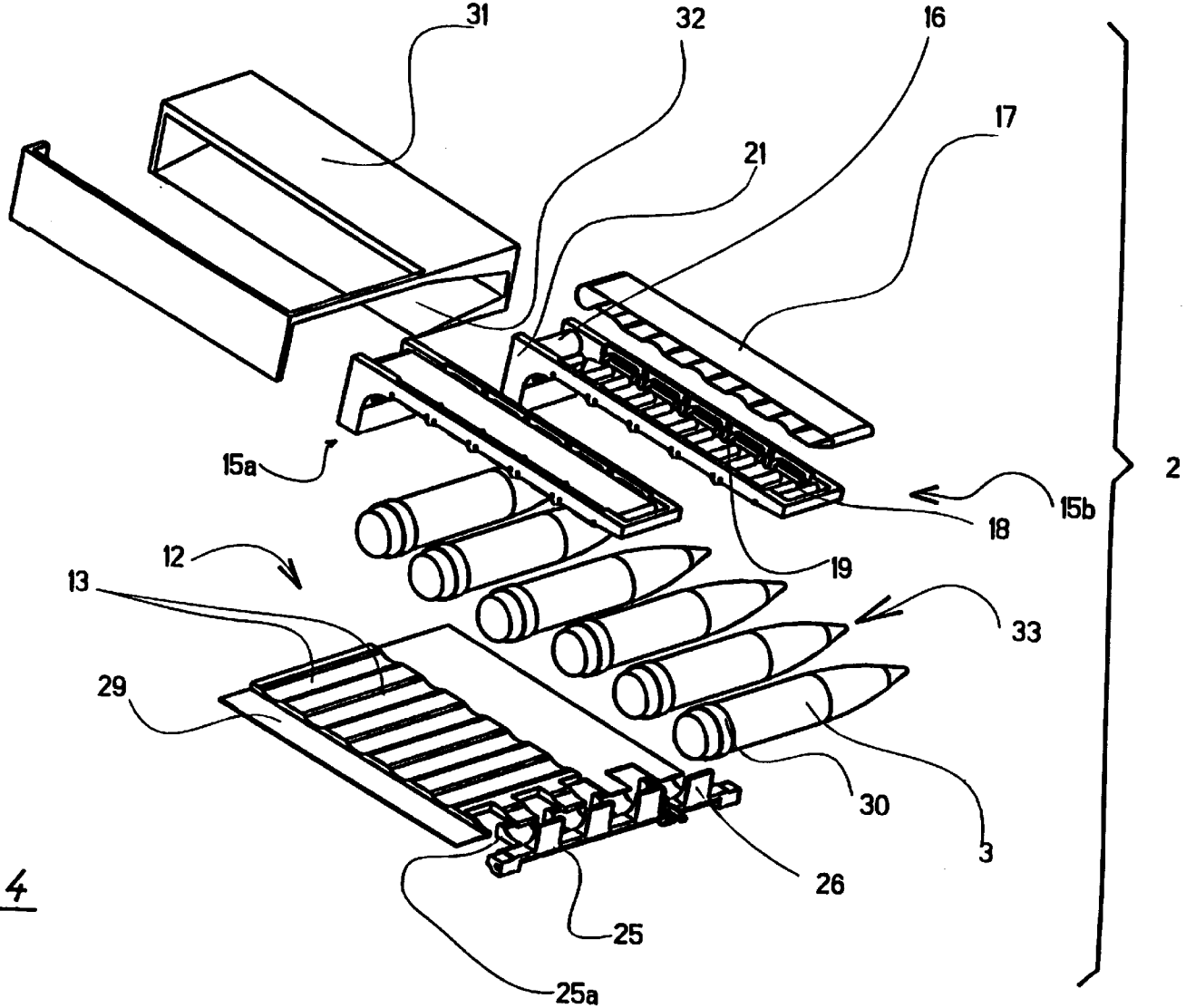
FIG. 4 is an exploded view of a row of the magazine receiving the projectiles.

FIG. 4 is an exploded view that shows a row 2 receiving projectiles.

The structure of this row is analogous to that described previously. It thus incorporates a plate 12 incorporating cells 13. A recess 29 will be provided on plate 12 so as to avoid the deterioration of belt 30 of projectile 3. Because, on the one hand, of the substantial mass of the projectile, and on the other, of their non-cylindrical external profile, two identical conveyor belts 15*a*, 15*b* parallel to one another are provided. Each conveyor belt has a structure of the type described previously and comprises: a closed band 17 made of a supple material, a drive roller 16, and end roller 18 and retention rollers 18 connected two-by-two by traction springs.

The different rollers are once again carried by a frame 21 integral with plate 12. A cowling 31 increases the rigidity of the assembly, inner profile 32 of the cowling will comprise two convergent planes defined so as to provide centring for the nose cones 33 of the different projectiles.

Plate 12 furthermore carries at its exit end a tipping part 25 mounted pivoting with respect to support plate 12. This part is L-shaped and incorporates on its branch 25*a* a housing 26 to accommodate a projectile.

Figure 7:
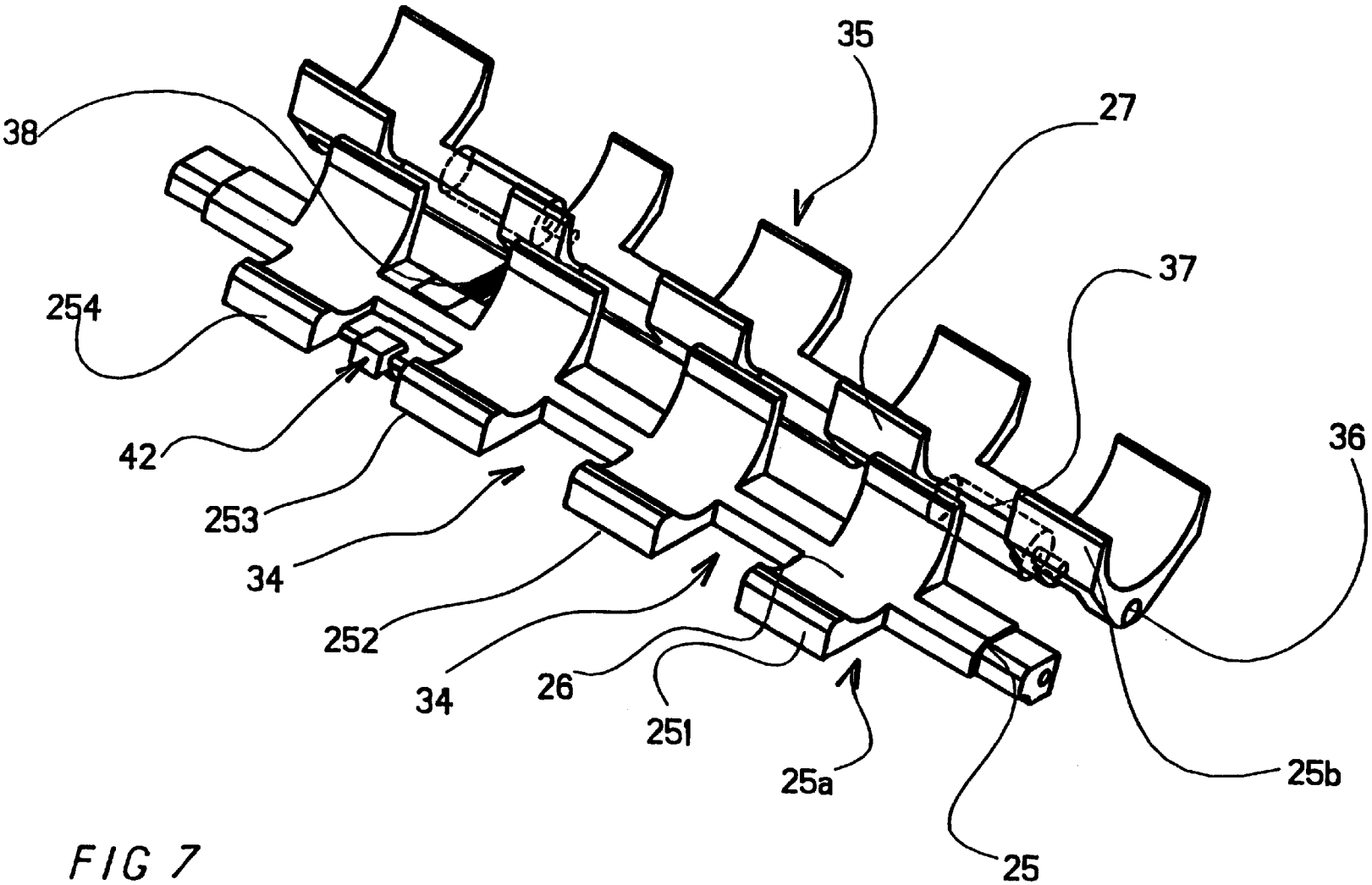
FIG. 7 is a partial perspective view showing the co-operation of a tipping part intended to receive a projectile and the pivoting bucket associated with it.

Tipping part 25 that is adapted to receive a projectile can be clearly seen in FIG. 7.

It extends over the full length of a projectile and incorporates four wings 251, 252, 253 and 254 that delimit spaces 34 intended to allow the passage of branches 27 of a bucket carried by the lift, as will be described later.

The structure of the lift will now be described with reference to FIGS. 6, 7, 8*a* and 10.

Lift 7 incorporates two compartments 8*a* and 8*b*. Lower compartment 8*b* is intended to receive the propellant charge modules and has six pivoting buckets 35 corresponding to the six sub-rows 11*a* to 11*f* of the magazine.

Upper compartment 8*a* receives a projectile 3 and incorporates a single bucket 35.

The pivoting of each bucket around its shaft 36 is driven by motor means 37 arranged in the lift.

Control and/or unlocking means 38 are also arranged in the lift and for each bucket 35.

They ensure, when the bucket is opposite a tipping part 25, the unlocking and/or pivoting of the tipping part towards bucket 35.

Figure 8A:
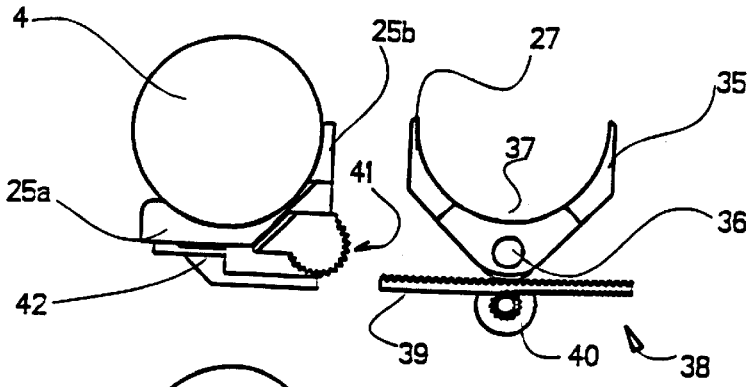
FIGS. 8*a* to 8*e* show different successive phases in the passage of an ammunition element from the magazine to the bucket of the transfer device.
Figure 8B:
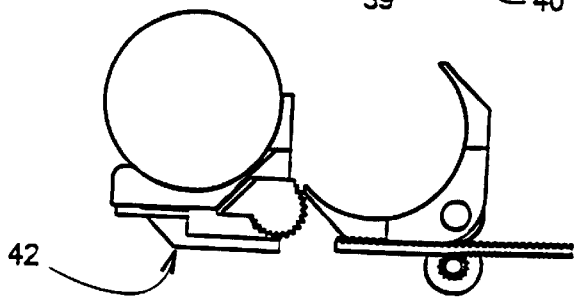

The structure of these means can be clearly seen in FIG. 8*a*.

They comprise, for each bucket 35, a rack 39 integral with the frame and the lift, rack whose translation is controlled by a motor 40.

This rack is intended to co-operate with a toothed sector 41 integral with tipping part 25. The translation of rack 39 thus causes tipping part 25 to pivot.

Figure 8C:
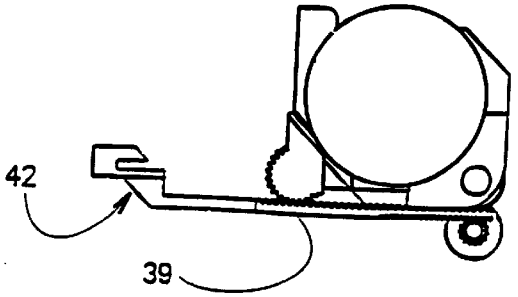
Figure 8D:
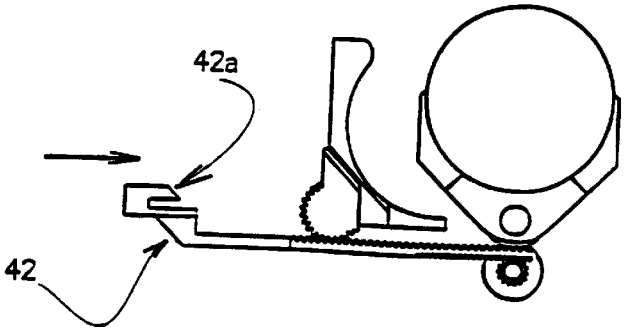

Tipping part 25 is furthermore immobilised in its closed position by an immobilising lock 42 (see FIGS. 8*d*, 6 and 7). This lock is mounted sliding on plate 12 against the action of a spring (not shown) and it incorporates a tab 42*a* (FIG. 8*d*) that co-operates with the tipping part to immobilise it.

When translating, rack 39 pushes lock 42 so as to release it before driving the pivoting of the tipping part.

The different motor means of the bucket (37 and 40) are activated in an order defined by means of a sequencer 10.

The lift lastly comprises means providing positioning for the buckets with respect to magazine 2.

These means comprise at least one sliding pin 43 integral with lift 7 (see FIG. 10) and co-operating with a hole 44 (FIG. 1) carried in the frame of the magazine.

Here, two pins 43 are provided that are each controlled by a specific motor 45.

The functioning of the device will now be described with reference notably to FIGS. 8 and 9.

FIGS. 8 and 9 show the different successive phases of the passage of an ammunition element (charge module or projectile) from magazine 2 to bucket 35 of the transfer device.

At the start, the device is in the position shown in FIG. 1, an ammunition element (projectile and charge) is present in each tipping part 25.

Sequencer 10 first of all drives the vertical movement of the lift until its reaches its position opposite the magazine rows. Reference marks, for example optical sensors or circuit-breakers, can be used to determine the correct position of the lift. Sequencer 10 then drives the removal of pins 43 ensuring the positioning of the buckets.

The buckets are thus in the position shown in FIG. 8*a*. The sequencer then drives motor 37 that causes the bucket to tip over and take up the position shown in FIG. 8*b*.

Thereafter, motor 40 is activated. It displaces rack 39. Said rack firstly pushes immobilising lock 42 releasing tipping part 25, then (by co-operating with toothed sector 41) it causes the passage of tipping part 25 from its closed position to its open position (FIG. 8*c*).

This tipping over is made possible by the specific structure of the tipping parts and the buckets. Indeed, branches 27 of buckets 35 can move freely in spaces 34 delimited by wings 251, 252, 253 and 254 of tipping parts 25.

Sequencer 10 then drives motor 37 bringing bucket 35 into a position where it takes away the ammunition element (FIG. 8*d*).

Figure 8E:
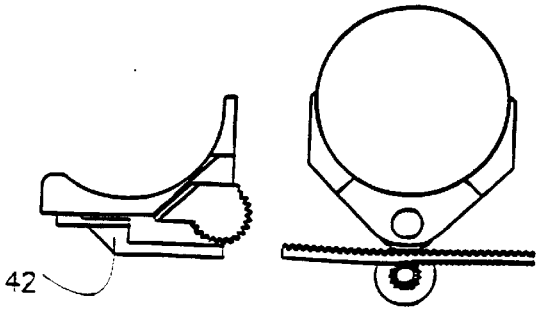

The sequencer lastly activates motor 40 bringing rack 39 back to its starting position. As a result, the tipping part returns to its closed position and lock 42 is repositioned to immobilise said tipping part (FIG. 8*e*).

Advantageously, the operation described above will be conducted so as to place a projectile and one or more propellant charge modules simultaneously in the lift.

The weapon feed time is thus improved, and consequently the firing rate.

For the propellant charge modules, the sequencer will drive one or several buckets of the lift depending on the number of charges required by the gun crew.

After positioning in the lift, the sequencer will conduct the other feed operations (conventional and not described here): positioning of the lift with respect to the loading tray, positioning of the projectile and charges on said tray, loading into the gun chamber.

The sequencer will also drive the progression of the different conveyor belts by the value of one ammunition element so as to position a projectile and modular charges once again in the empty tipping parts.

The feed device according to the invention can just as easily enable the magazine to be replenished from the lift.

FIGS. 9*a* to 9*e* thus show the different phases in the passage of an ammunition element from bucket 35 of the transfer device to magazine 2.

The sequencer drives the different motorizations in a different order in this case to those described previously.

Figure 9A:
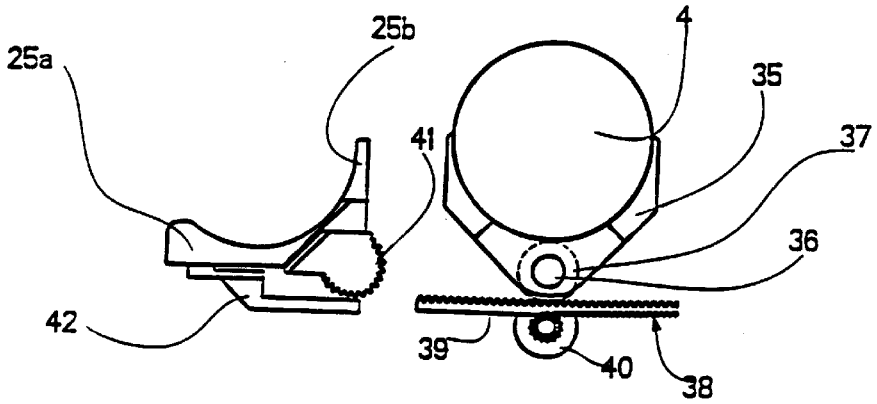
FIGS. 9*a* to 9*e* show different successive phases in the passage of an ammunition element from the bucket of the transfer device to the magazine.

The starting position is shown in FIG. 9*a*. The ammunition element is position in bucket 35.

Figure 9B:
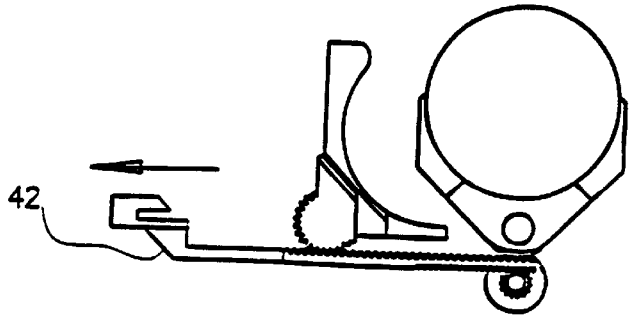
Figure 9C:
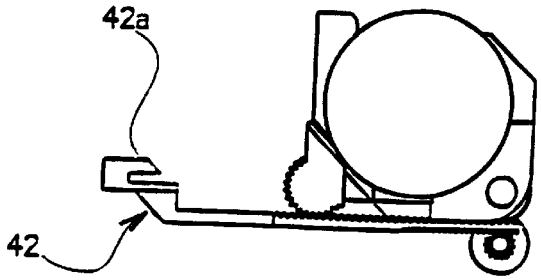
Figure 9D:
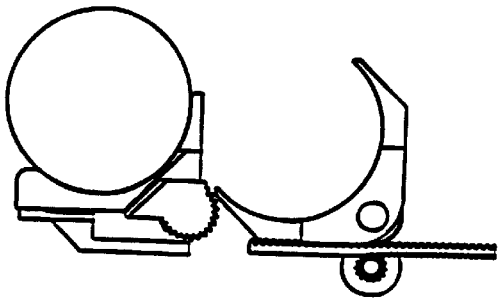

Sequencer 10 firstly drives motor 40 that displaces rack 39. Lock 42 is released and the empty tipping part takes up its open position (FIG. 9*b*). The sequencer then drives motor 37 making bucket 35 pivot (FIG. 9*c*). Motor 40 is then activated and the retraction of the rack firstly causes the tipping part to return to its closed position, and secondly causes immobilising lock 42 to return to its starting position (FIG. 9*d*).

Figure 9E:
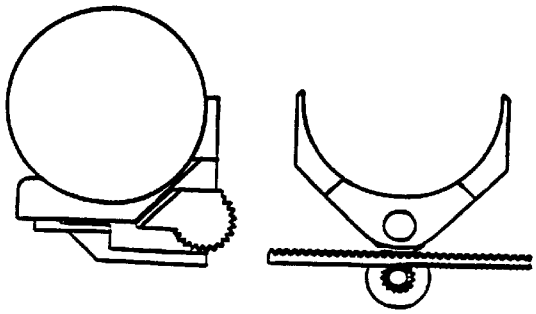
Figure 10:
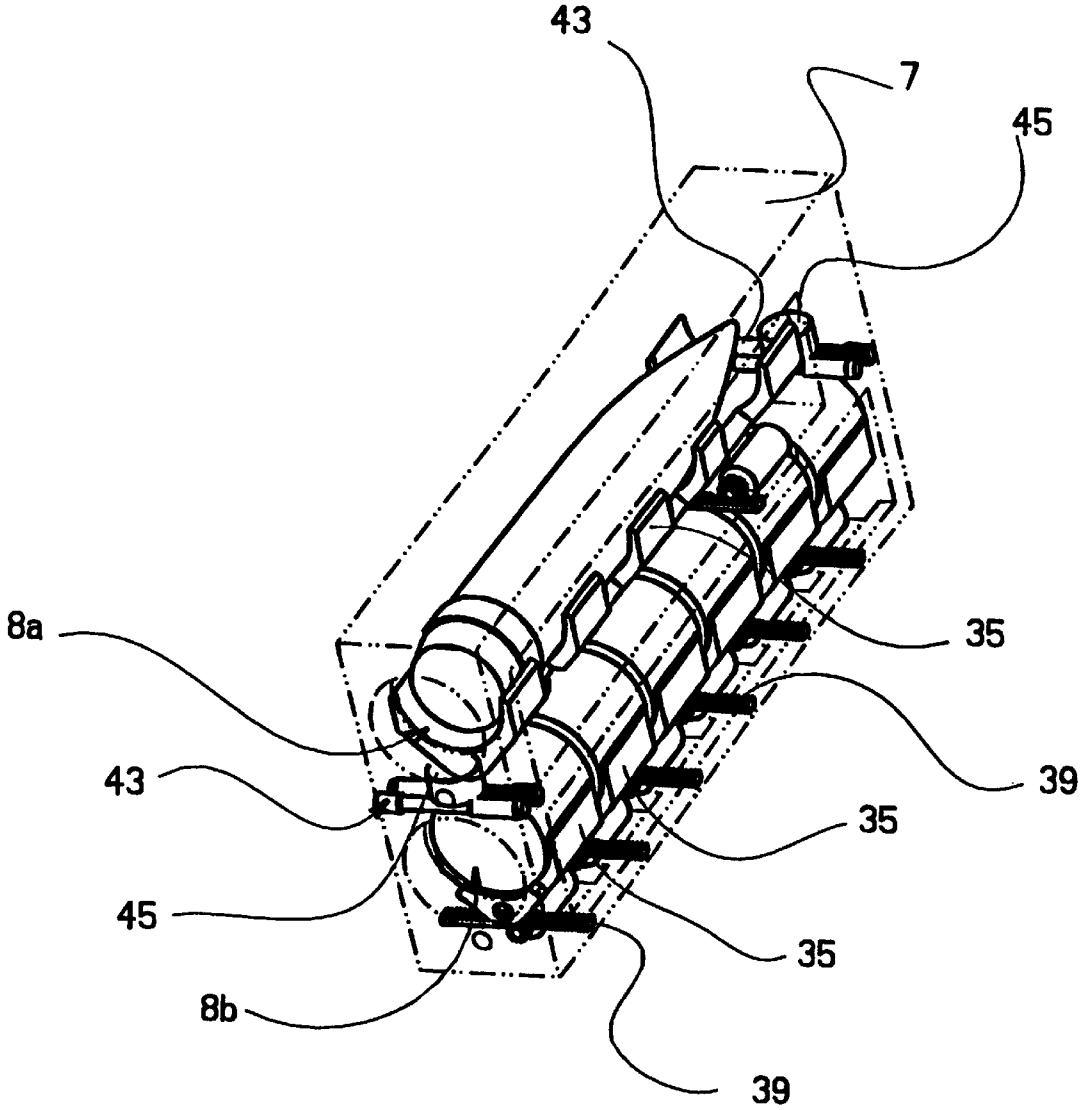
FIG. 10 is a perspective view of the lift.

Bucket 35 is lastly brought back to its starting position (FIG. 9*e*).

If the magazine is empty, the conveyor belts can be driven in the opposite direction to that used previously so as to bring the ammunition element thus positioned in the tipping part to the bottom of the magazine.

This return is made easier by the fact that tipping part 25, thanks to its branch 25*b*, firmly presses the ammunition element that it contains against band 17 of the conveyor belt and retention roller 19. The conveyor belt can therefore easily drive the ammunition element in rotation to bring it to another position in the row.

Different variants are possible without departing from the scope of the invention.

Thus, it is possible for a feed system to be designed that contains only projectiles or only propellant charges. The sub-rows intended for the propellant charge modules can be of a different number, certain sub-rows can advantageously be filled by propellant charge modules of a different sort, for example sub-rows containing live modules can be alternated with sub-rows containing slow modules.

What is claimed is:

1. An ammunition element feed device for an artillery cannon, comprising:

at least one storage magazine for ammunition elements, said magazine for housing at least one row of ammunition elements;

a device to transfer ammunition elements from the magazine to a loading shoot;

and motor means for moving ammunition elements from a row to the transfer device, wherein each row of said magazine comprises a support plate for supporting ammunition elements so that the longitudinal axes of said elements are perpendicular to a direction of movement of elements along a row, and the means for moving ammunition elements from a row to the transfer device comprises at least one conveyor belt for contacting such elements in a row.

2. A device according to claim 1, wherein the support plate includes reception cells for ammunition elements.

3. A device according to claim 2, additionally comprising at least two retention rollers for pressing the conveyor belt on each ammunition element, and elastic return means for separating the belt from an ammunition element.

4. A device according to claim 3, further comprising a frame, the frame for abutting ammunition elements wherein each retention roller is carried by a first lever able to pivot with respect to the frame, the first lever fastened by a traction spring to a second lever carrying the next adjacent roller.

5. A device according to claim 1, further comprising two side cheeks for providing guidance for ammunition elements.

6. A device according to claim 1, further comprising two conveyor belts parallel to each other, each belt for pressing a different part of an ammunition element.

7. A device according to claim 6, further comprising a cowling having a profile defined by two convergent planes corresponding to the shape of a nose cone, for positioning the nose cone an ammunition element within the cowling between said two conveyor belts.

8. A device according to claim 1, further comprising: at least one tipping part, having a closed position, and an open position, the tipping part pivotable with respect to the support plate, the tipping part being L-shaped and having a first branch in the closed position in the extension of the support plate and forming a housing to accommodate an ammunition element, and a second branch perpendicular to the first for ensuring that an element is retained in the magazine, the tipping part being located between a row of the magazine and the transfer device, whereby pivoting of the tipping device from the closed position to the open position allows passage of an ammunition element from the magazine to the transfer device.

9. A device according to claim 8, wherein a controllable lock ensures immobilization of the tipping part.

10. A device according to claim 8, wherein the transfer device comprises at least one pivoting bucket, drive means for pivoting the bucket, control and unlocking means for ensuring, when the bucket lies opposite the tipping part, that the tipping part unlocks and pivots in the direction of the bucket, and a sequencer, connected to the drive means and the control and unlocking means, whereby the drive means and the control and unlocking means can be activated in a predefined order by means of the sequencer.

11. A device according to claim 10, wherein the tipping part comprises at least two wings forming a fork, a space between the two wings allowing passage of one branch of the bucket.

12. A device according to claim 10, wherein the control and unlocking means comprise at least one rack integral with a support of the bucket, a motor for translation of the rack cooperating with a toothed sector integral with the tipping part translation of the rack causing the tipping part to pivot.

13. A device according to claim 12, wherein the rack is located so that during translation it releases the lock, thereby immobilizing the tipping part.

14. A device according to claim 10, wherein the bucket is integral with a lift translating with respect to the storage magazine in a direction perpendicular to the rows of the magazine, the lift incorporating means for positioning of the bucket with respect to a row of the magazine.

15. A device according to claim 14, wherein the positioning means comprise at least one sliding pin integral with the lift and for cooperating with a hole in the magazine frame.

16. A device according to claim 14, wherein the lift forms two compartments, a first compartment for receiving a projectile transfer bucket and a second compartment comprising at least two buckets to receive propellant charge modules.

17. A device according to claim 16, wherein the storage magazine comprises at least two groups of two superimposed rows, a first row for projectiles and a second row, arranged above or below the first row, and comprising at least two sub-rows for propellant charge modules, such that when the first compartment of the lift is positioned opposite the first row, the second compartment of the lift is positioned opposite the sub-rows for propellant, for transferring a projectile at the same time as charge modules.

18. Device according to claim 6, further comprising: at least one tipping part having a closed position and an open position pivotable with respect to the support plate, the tipping part being L-shaped with a first branch arranged in the closed position in the extension of said support plate and forming a housing to accommodate ammunition elements, and a second branch perpendicular to said first branch for ensuring that an ammunition element is retained in the magazine, the tipping part being located between the row of the magazine and the transfer device, whereby pivoting of the tipping device from the closed position to the open position will allow passage of ammunition elements from the magazine to the transfer device.

* * * * *